US005398940A

United States Patent [19]

Derst, III

[11] Patent Number: 5,398,940

[45] Date of Patent: Mar. 21, 1995

[54] SOCCER HEADER PRACTICE APPARATUS

[76] Inventor: Edward J. Derst, III, P.O. Box 22849, Savannah, Ga. 31403-2849

[21] Appl. No.: 110,111

[22] Filed: Aug. 20, 1993

[51] Int. Cl.[6] ..... A63B 43/00; A63B 69/00

[52] U.S. Cl. ..... 273/411; 273/58 C; 273/413

[58] Field of Search ..... 273/411, 413, 414, 58 R, 273/58 C

[56] References Cited

U.S. PATENT DOCUMENTS

| | | | |
|---|---|---|---|
| 4,462,599 | 7/1984 | Brown | 273/411 |
| 4,576,379 | 3/1986 | Juhasz | 273/411 |
| 4,679,793 | 7/1987 | Gonzalez | 273/413 X |
| 4,706,964 | 11/1987 | Genovese | 273/413 |
| 4,948,150 | 8/1990 | Daly, Jr. et al. | 273/411 |
| 5,083,797 | 1/1992 | Vartija et al. | 273/414 |

FOREIGN PATENT DOCUMENTS

| | | | |
|---|---|---|---|
| 2603196 | 3/1988 | France | 273/411 |

*Primary Examiner*—William H. Grieb

*Attorney, Agent, or Firm*—Jones & Askew

[57] ABSTRACT

A soccer header practice and training apparatus which develops and improves an athlete's ability to head a soccer ball. The apparatus is formed from a rigid and hollow tubular support member which is bent at about 90° to produce a horizontal and vertical portion. A tether extends through and along the length of the support member. The tether is of sufficient length such that the tether portion extending beyond the horizontal portion is attached to a soccer ball and the other end of the tether freely falls from the bottom of the vertical portion of the support member. Such arrangement permits the height of the ball to be adjusted. The apparatus is secured to a soccer goal by a clamping mechanism attached to the vertical portion of the support member.

10 Claims, 2 Drawing Sheets

SOCCER HEADER PRACTICE APPARATUS

TECHNICAL FIELD

The present invention relates generally to a training device for athletes of all ages to develop and improve the athletes' abilities to head a soccer ball.

BACKGROUND OF THE INVENTION

Soccer has become an extremely popular sport among athletes of all ages. Heading a soccer ball, that is, hitting the soccer ball with ones head, is a necessary and useful skill in the game of soccer, particularly since a player is not permitted to use their arms or hands during play of the game.

Thus, there is a demand for a soccer header training device that is easy to use, portable, and inexpensive. Children particularly benefit from a header practice apparatus because heading a soccer ball is an unnatural action and children are often fearful of an on-coming ball in the direction of their head and face. The present device helps to eliminate this element of fear in that the ball is suspended motionless until it is headed. Novices are not, however, the only athletes who benefit from the training device. Experienced soccer players can sharpen their skills more quickly with the present device as there are no balls to retrieve and no partner is required to throw or kick the soccer ball to the athlete. Moreover, the height of the ball is easily adjustable, thereby permitting the athlete to practice various head shots.

The prior art soccer training devices do not achieve the advantages provided by the soccer header apparatus of the present invention. Existing soccer ball suspending devices are more complicated, less portable and/or less effective. Devices such as that of U.S. Pat. No. 4,462,599 to Brown, provide soccer header training devices that are more complicated, inherently less portable and more expensive. The device of Brown, is a large, self standing apparatus consisting of a main support with a horizontal portion and a lengthy vertical section which is supported by a base anchored to the ground. The base is filled with sand and required to be heavy to support the device during use.

Another type of prior art device is shown by U.S. Pat. No. 5,083,797 to Vartija et al. Vartija et al. discloses an apparatus which simply encases a soccer game ball within a net and then which is attached to an adjustable tether. The tether contains a handle at its end. In use, another person must hold the handle for the athlete to practice his or her heading techniques. The disadvantages of this are numerous. Most importantly, a second person is required to use the device, the device lacks any stability (other than the person holding it), a predetermined soccer ball height cannot be exactly repeated, and it would seem that a very strong person would be required to hold the training device for the athlete to practice.

Additionally, soccer header devices with permanent installations are known in the art. These devices, however, require the permanent installation of a base tube within the ground. This base tube must be set in concrete. The support tube then is inserted into the base and is substantially taller than the device of the instant invention. These devices are inherently not totally portable and the bases must be set in the ground. This arrangement is potentially harmful because of the fact that when the base remains in the ground of a soccer field, soccer players may be injured by tripping or falling on it, for example.

The present inventor determined that it is desirable to have a soccer practice device useful for practicing head shots that meets the following criteria. First, it is desirable to have same be portable and usable at any soccer field equipped with a goal. Secondly, it is desirable to have the apparatus constructed so that the position at which the ball is held for practicing a head shot may be easily adjusted, both vertically (height off the ground) and with respect to its location along the opening of the goal. It is desirable that it be relatively inexpensive, easy to adjust, usable by one person and not requiring heavily weighted support stands or permanently installed receptacles in the field of play. Heretofore, the prior art has not provided a soccer practice device that combined all of these desirable features.

Thus, it is desirable to have a device such as the present soccer header training apparatus to overcome the disadvantages of the prior art training devices.

SUMMARY OF THE INVENTION

The present invention is designed to meet the above described need and to overcome many drawbacks of prior art soccer header training devices. Broadly stated, the present invention is a training and practicing device that allows an athlete to learn and sharpen soccer heading techniques. The present apparatus is designed to be lightweight and portable and, therefore, generally less expensive than some prior art devices.

The preferred form of the instant training device generally comprises a tubular support bar which is curved at about a ninety degree angle to form a horizontal and vertical portion. A clamping mechanism is attached to the vertical portion of the support to secure the training device to the cross bar of a soccer goal. The clamping mechanism in the preferred form is in the form of a conventional C-clamp. A tether extends through the support member and is of sufficient length such that it extends beyond each end of the support. At the end of the horizontal portion, the tether is connected to a soccer ball while at the end of the vertical portion, the excess tether freely falls.

With this arrangement, the height of the soccer ball can be adjusted to accommodate athletes of all heights and abilities. The height is adjusted by pulling either the ball or free end of the tether until the ball reaches the desired position. The free end of the tether is then secured to maintain the selected height. In a preferred form, the end of the horizontal portion is fitted with a grommet inserted within the support member to prevent chaffing of the tether and for controlling the momentum of the ball.

It is therefore an object of the present invention to provide a lightweight, portable soccer header training device.

It is a further object of the present invention to provide an improved training device that can be attached to soccer goals of varying dimensions.

It is a further object of the present invention to provide an improved practicing device for an athlete which the athlete can use without requiring the assistance of another person.

It is still a further object of the present invention to provide an improved training device which is stable in use and safe for athletes of all ages.

That the present invention accomplishes these objects and overcomes the drawbacks of prior art soccer header training devices will be appreciated from the detailed description of the preferred embodiment to follow.

DETAILED DESCRIPTION OF THE PREFERRED EMBODIMENT

Figure 1:
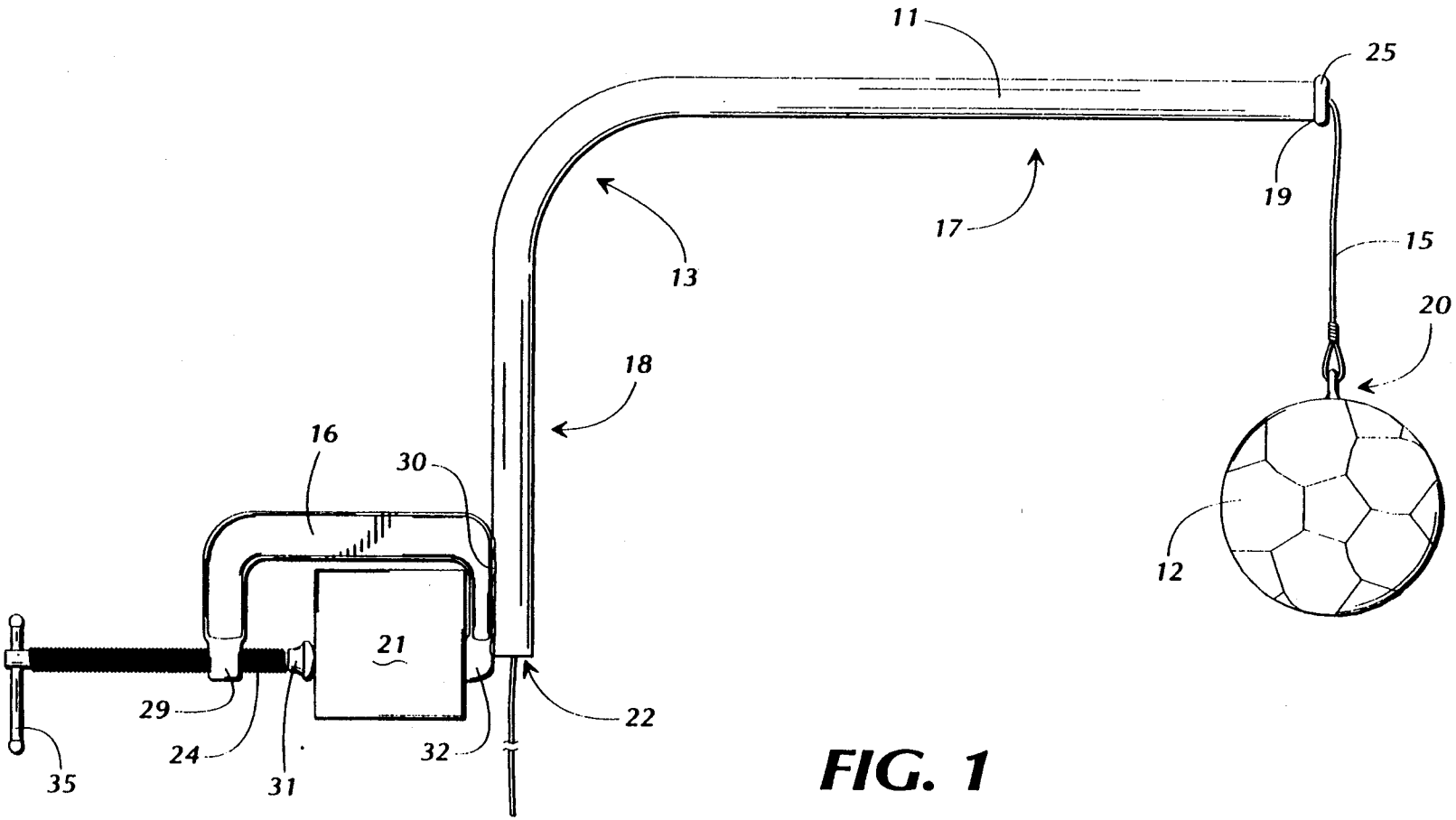
FIG. 1 is a side elevational view of the preferred embodiment of the present invention.

Turning now to the drawing figures in which like numerals reference like parts, the preferred embodiment of the present invention will now be described. The improved soccer header practice apparatus of the present invention is indicated generally at 10. The training device is constructed of a rigid hollow support member 11. The support member is formed from a hollow tubular structure which is bent at about a 90° angle indicated at 13 to form a horizontal portion 17 and a vertical portion 18.

As may be seem from inspection of the drawing FIGS., in the preferred embodiment the tether 15 is connected to the soccer ball 12 via connecting apparatus indicated generally at 20.

tin the preferred embodiment, tether 15 extends within and along the length of the support member 11 and extends beyond the ends of the support member. The tether extends beyond the first end 19 of the horizontal portion and beyond the open bottom end 22 of the vertical portion of the support member. The tether freely moves within the support member 11 such that the height of the soccer ball can be adjusted. A toroidal grommet 25 is inserted into first end 19 of support member 11.

Also in the preferred embodiment as shown in FIG. 1, the soccer header training apparatus is designed to be attached to the cross bar of a soccer goal indicated generally at 21 so that the device is readily portable. The clamping member 16 as shown in the preferred embodiment as a conventional C-clamp which thereby allows the apparatus to be secured to the cross bars of soccer goals of various dimensions. In the preferred embodiment, C-clamp 16 is welded to vertical portion 18 of support member 11 along a welded joint 30. However, any arrangement for connecting the clamp to the support member that will securely hold these two parts together may be used in embodiments of the present invention. Many equivalent devices will suggest themselves to those skilled in the art including metal screws, bolts, hose clamps and integral formation of the two parts.

The C-clamp conventionally includes a threaded collar 29 into which a threaded shaft or lead screw 24 is inserted through which a lever arm 35 is passed for applying torque to the lead screw. The lead screw is conventionally terminated in a gimbaled contact plate 31 that opposes a stationary contact plate 32. As is known to those skilled in the art, this arrangement allows the distance between contact plates 31 and 32 to be selectively varied and thus allows the plates to be secured to horizontal goal support 21 by the application of compression as handle 35 is operated to advance lead screw 24 when the apparatus is in its selected position.

As noted hereinabove, the C-clamp is preferably welded to vertical portion 18. This may be accomplished by any known method, but preferably using a consumable electrode welding process.

It should be understood that the clamping apparatus of the present invention is not limited to a conventional C-clamp, although same is preferred. There are some applications in which it may be desirable not to mar the horizontal goal support 21, in which case a clamp having larger contact surfaces, more in the nature of a vise, would be preferable. Also, spring loaded devices may be used. The important feature of the clamp is that it be selectively removable with relative ease, yet may be secured to goal supports of various widths with sufficient force so that it does not become detached as the apparatus is used, i.e., when players are striking ball 12 in a relatively violent manner.

Figure 2:
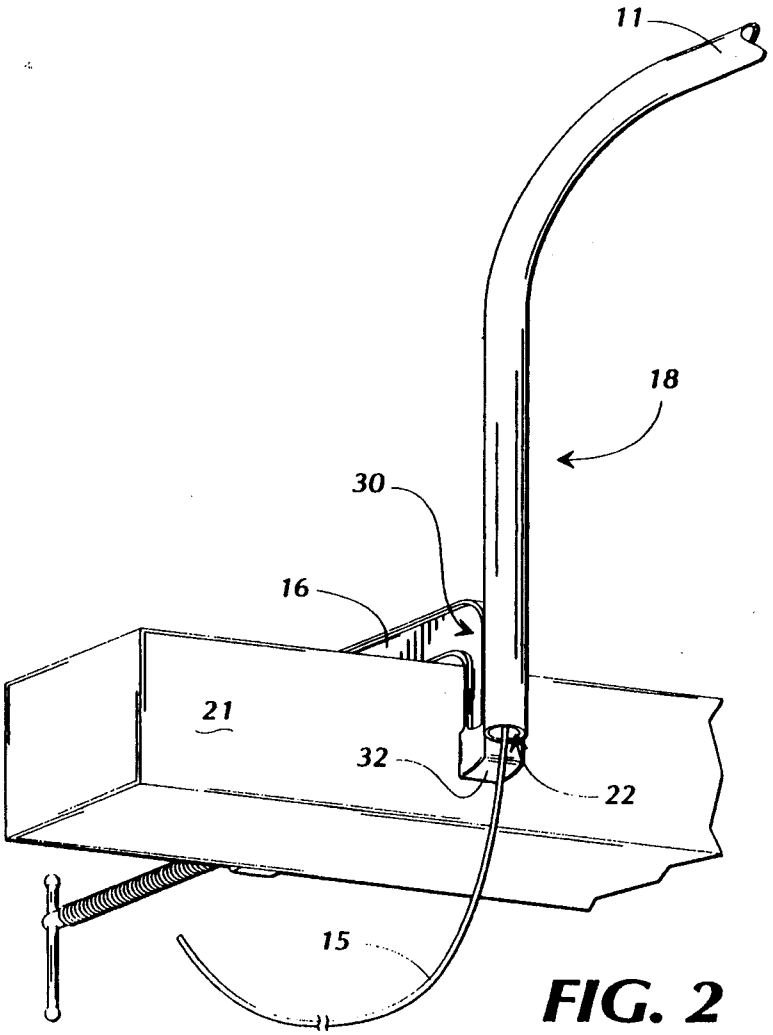
FIG. 2 is a fragmentary perspective of the clamping mechanism and the bottom end portion of the support member of the device of FIG. 1.

Turning next to FIG. 2, a fragmentary underside view of the bottom end portion of the support member 11 is shown. The vertical portion 18 of the support member 11 is shown in FIG. 2 as having an open bottom end 22. Such a hollow tubular configuration of the support member permits the tether 15 to extend through and past the support member to permit excess tether to freely fall such that the position of the soccer ball 12 can be easily adjusted to various heights.

While the distal end of tether 15 from the ball is shown as hanging free of FIGS. 1 and 2, it will be readily understood that it is available for securing to any convenient device in order to fix the height of ball 12 off the ground. For example, it may be conveniently wrapped about horizontal goal support 21 and tied off. Alternately, it may be wrapped around clamp 16 or vertical portion 18 of support member 11 and secured in any convenient fashion, although a simple half hitch knot is then found to be sufficient in most applications of the apparatus. Alternately, the free end of tether 15 can be fitted with an adjustable stop (not shown) to fix the length of the portion of the tether that is used, and thus the height of the ball.

Also shown in FIG. 2 is the preferred form of a clamping mechanism to support the soccer header training apparatus to a conventional soccer goal, the cross bar of which is shown at 21. The clamping mechanism shown generally at 16 in the preferred embodiment is formed of a conventional C-clamp shown at 23.

Figure 3:
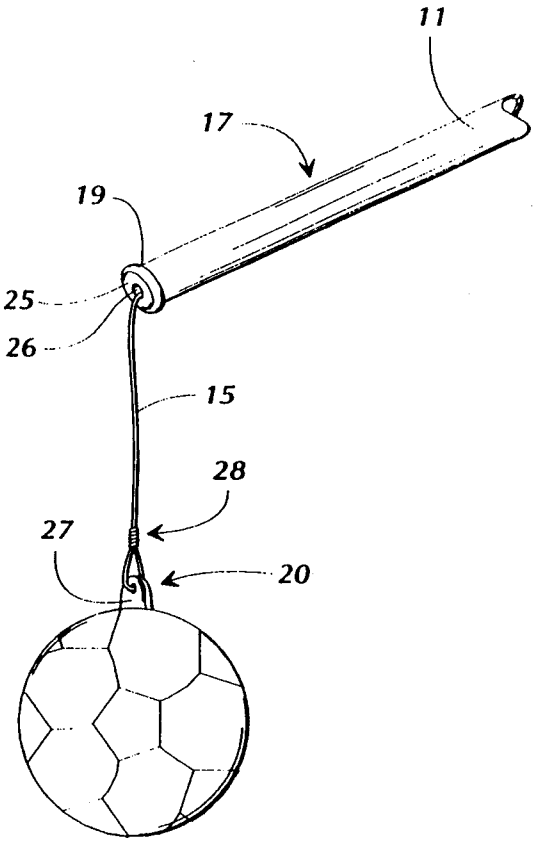
FIG. 3 is a fragmentary top perspective of the end of the horizontal portion of the support member of the device of FIG. 1.

FIG. 3 is a top fragmentary view showing the end portion 19 of the horizontal portion 17 of the support member 11 wherein tether 15 extends through the hollow tubular support member 11. At the end 19 of the horizontal portion 17 of the support member is a nylon grommet 25. The grommet comprises, in the most preferred form, a truncated toroid through which a hole 26 passes and through which the tether extends. At the truncated side of the toroid, a cylindrical extension is snugly journaled into end 19 of support 17. A portion of the toroid has a larger diameter than end 19, and is therefore seated on the edge of end 19 so that the grommet can not be pushed completely inside of tubular support member 11.

The shape of grommet 25 through which hole 26 passes is such that it restricts any sideways motion of the tether 15 at the end portion 19. The grommet in the preferred form serves principally as an anti-chafing device. It is preferable to use a plastic material such as nylon having a relatively low coefficient of friction with conventional rope material such as nylon, polypropylene, cotton and hemp. Both the relatively low coefficient of friction and the smoothness of the rounded surface of this partially toroidal grommet minimizes chafing on tether 15 where it exits support member 11.

Also shown in FIG. 3 is the means by which the soccer ball 12 is connected to the tether 15. The connecting means are shown generally at 20. While any conventional means of attaching the tether to the soccer ball may be utilized, in the most preferred embodiment of the present invention, there is shown somewhat elastic portion 27 which is attached to the soccer ball 12 and configured with a loop portion. Tether 15 extends through the loop portion and may be secured in any manner. As shown in FIG. 3 of the preferred embodiment, it may be tied in a knot indicated at 28.

The hollow tubular rigid support 11 may be formed of any sturdy material but in the most preferred embodiment it is formed of a metal and most preferably aluminum. The support member may also be bent in any conventional manner but in the most preferred embodiment the metal tube is bent to form a 90° angle by a pipe bending procedure known to those of ordinary skill in the art. More particularly, embodiments of the present invention have been successfully constructed using conventional aluminum electrical conduit bent about a conventional conduit bending jig of appropriate radius of curvature for the conduit in use.

Moreover, the tether 15 may be formed of any flexible material but in the most preferred embodiment it is formed of as conventional rope-like structure that is relatively inelastic. However, it should be noted, that tether 15 may also be formed of an elastic material. The elastic portion 27 which connects the tether to the soccer ball 12 in the most preferred embodiment is formed of a rubber-like material. Of course it is apparent to those skilled in the art that this portion, too, may be formed of an inelastic material.

In use, the soccer header training apparatus 10 is connected to the cross bar of the soccer goal 21 by the clamping mechanism 16. Lead screw 24 is then adjusted to firmly secure the device 10 to the soccer goal. It is apparent that such a configuration of the present invention can be attached to goal crossbars of various dimensions. Thus, the apparatus 10 extends above and forward of the soccer goal and soccer ball 12 hangs therefrom. The athlete may then adjust the height of the soccer ball by pulling the free end which extends beyond the bottom end portion 22 of the support member. Once the desired height of the ball is achieved the free end portion of the tether is then secured in any known manner. For example, the free end may be tied to clamping mechanism 16, to the support member 10 or even to the cross bar of the soccer goal. In another form of use of the device, the free end may also merely be held by another person. Once the height of the soccer ball is secured, the athlete may then practice heading the soccer ball. It is apparent from the instant invention that there is no need to retrieve the ball once the athlete executes the desired heading technique.

In addition to practicing head shots with soccer ball 12 held at a fixed height, the apparatus is usable with an individual such as a coach manipulating the position of the ball by selectively pulling tether 15 and slowly releasing same allowing the force of gravity on ball 12 to pull the tether out of first end 19 of the support member 11. Since the preferred form of the present invention is arranged so that opening 22 stands clear of goal support 21, or other member to which the apparatus is clamped, this may be accomplished without tangling the tether.

The foregoing has been a complete description of the preferred embodiment of the present invention and disclose what the inventor believes to the best mode of practicing the invention while, at the same time, trying to point out aspects of the preferred embodiment that are not considered critical or important. In view of the foregoing description of the preferred embodiment, the embodiments of the present invention will suggest themselves to those skilled in the art. Therefore, the scope of the present invention is to be limited only by the claims below in equivalence thereof.

I claim:

1. A portable ball assembly for use as a training and practice device comprising:

a tubular hollow support member, curved to form a horizontal portion terminating at a first end and a vertical portion terminating at a second end, said portions forming substantially a right angle therebetween;

a ball;

a tether engaged with said support member and having at least a portion thereof extending from said support member near said first end, said portion being terminated by means for connecting said ball thereto;

a clamping member connected to said vertical portion of said support member for selectively securing said assembly to goal supports of varying widths;

said tether comprising two ends, a first end secured to said ball, and a second end;

said tether being threaded through said hollow support member such that said tether extends along the length of said support members;

said second end of said tether extends through said second end of said vertical portion of said support member; and said first end of said tether extends through said first end of said horizontal portion of said support member.

2. The portable ball assembly of claim 1 wherein said clamping member is disposed on an outer surface of said vertical portion of said support member thereby leaving said second end of said vertical portion open.

3. The portable ball assembly of claim 1 wherein said clamping member is disposed on an outer surface of said vertical portion of said support member such that said assembly extends above and forward of said goal.

4. The portable ball assembly of claim 1 wherein:

a vertical position of said ball is adjustable along the length of said support member by pulling one of said ends of said tether until a desired position is achieved; and said second end of said tether is secured to maintain said desired position

5. The portable ball assembly of claim 1 wherein said first end of said horizontal portion comprises a grommet to limit sideways motion of said tether within said horizontal portion of said support member.

6. A portable assembly for use as an athletic training and practice device comprising:

a tubular hollow support member, curved to form a horizontal portion terminating at a first end and a vertical portion terminating at a second end, said portions forming substantially a right angle therebetween;

a tether engaged with said support member and having at least a portion thereof extending from said support member near said first end, said portion being terminated by means for connecting a ball thereto; and a clamping member connected to said vertical portion of said support member for selectively clamping said assembly to goal supports of varying widths;

said tether comprising two ends, a first end secured to said means for connecting a ball, and a second end;

said tether being threaded through said hollow support member such that said tether extends along the length of said support member;

said second end of said tether extends through said second end of said vertical portion of said support member; and said first end of said tether extends through said first end of said horizontal portion of said support member.

7. The portable assembly of claim 6 wherein said clamping member is disposed on an outer surface of said vertical portion of said support member thereby leaving said second end of said vertical portion open.

8. The portable assembly of claim 6 wherein said clamping member is disposed on an outer surface of said vertical portion of said support member such that said assembly extends above and forward of said goal when clamped to an upper cross bar of said goal.

9. The portable assembly of claim 6 wherein:

a vertical position of said means for connecting a ball is adjustable along the length of said the support member by pulling one of the said ends of said tether until a desired postion is achieved; and said second end of said tether is secured to maintain the desired position.

10. The portable assembly of claim 6 wherein said first end of said horizontal portion comprises a grommet to limit sideways motion of said tether within said horizontal portion of said support member.

* * * * *